US005913662A

United States Patent [19]

Huntley

[11] Patent Number: 5,913,662

[45] Date of Patent: Jun. 22, 1999

[54] DIFFUSION PUMP WITH TWO INLETS AND TWO STAGE PUMPING CAPABILITY

[75] Inventor: Graeme Huntley, Crawley, United Kingdom

[73] Assignee: The BOC Group plc, Windlesham, United Kingdom

[21] Appl. No.: 08/799,890

[22] Filed: Feb. 13, 1997

[30] Foreign Application Priority Data

Feb. 19, 1996 [GB] United Kingdom ..... 9603434

[51] Int. Cl.[6] ..... F04B 9/12

[52] U.S. Cl. ..... 417/152

[58] Field of Search ..... 417/152, 503

[56] References Cited

U.S. PATENT DOCUMENTS 2,997,956 8/1961 Stewart ..... 103/41
3,302,864 2/1967 Nicolas .
4,147,478 4/1979 Vork ..... 417/458
5,137,429 8/1992 Broadhurst ..... 417/152

FOREIGN PATENT DOCUMENTS 1 254 532 5/1961 France .

*Primary Examiner*—Timothy S. Thorpe
*Assistant Examiner*—Ehud Gartenberg
*Attorney, Agent, or Firm*—David M. Rosenblum; Salvatore P. Pace

[57] ABSTRACT

A diffusion pump for evacuating a chamber is provided with a hollow outer body including an outlet for connection to a backing pump and a base for containing a working fluid. A vapor chimney extends from the base within the hollow outer body and includes at least two spaced apart jet stages. The working fluid is heated when present in said base. Two or more inlets are formed in the hollow outer body for communicating with said at least one chamber to be evacuated. The presence of the two inlets provides the possibility of differential pumping.

1 Claim, 1 Drawing Sheet

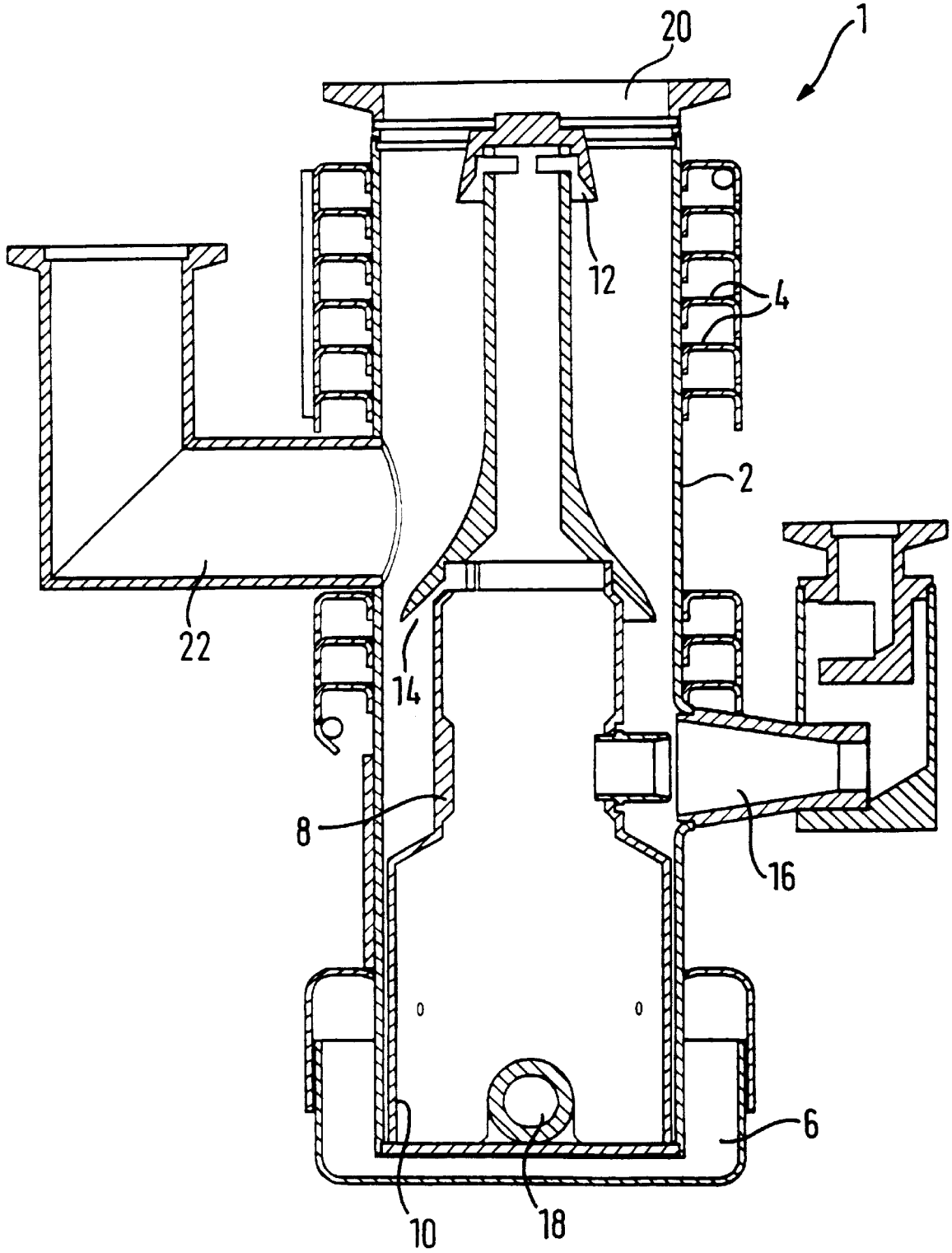
20
1
12
4
2
22
14
8
16
6
10
18

DIFFUSION PUMP WITH TWO INLETS AND TWO STAGE PUMPING CAPABILITY

BACKGROUND OF THE INVENTION

The present invention relates to vacuum pumps of the type known as diffusion pumps.

Diffusion pumps are well known and widely used for the attainment of high and ultra high vacuum. When used with modern working fluids and accessories, they can produce pressures approaching $10^{-10}$ mbar. The pumps are generally incapable of exhausting directly to the atmosphere and require the use of a backing pump, commonly an oil sealed rotary vacuum pump, in conjunction with the diffusion pump itself.

Diffusion pumps generally comprise a substantially cylindrical outer body which is cooled by, for example, coils helically wound around the outside of the body through which cooling water can be circulated or alternatively by air cooled fins attached to the outside of the body.

Within the outer body is positioned a hollow "chimney" sitting at, or close to, the base of the outer body and which tapers (continuously or, more usually, in stages) upwardly from the base. The chimney is generally contained within the outer body and is positioned substantially concentrically therein.

Across the top of the chimney but not in contact therewith is a top cap having a generally circular portion of somewhat larger diameter than the top of the chimney and positioned symmetrically with regard to the chimney and having a downwardly projecting annular side portion whose lower edge is somewhat beneath the upper edge of the chimney. The top cap is therefore substantially an inverted "cup shaped" component positioned about the top of the chimney with a circular or annular passageway therebetween. The top cap and the adjacent portion of the chimney defining the annular passageway is known as a 'jet stage'.

A heater is provided in the base of outer body and, prior to use of the pump, a working oil is placed in the base of the body to a height above the lower edge of the chimney positioned within the body. The oil is usually a low vapour pressure oil although some versions of diffusion pumps use mercury.

A pump inlet is positioned in the outer body above the top cap and an outlet in the side of the body towards the base of the chimney but above the oil level. The outlet is normally connected to a backing pump as described above.

In use of pumps of this type, the backing (rotary) pump is turned on and left running continuously, a pressure of at least 0.1 mbar being required on the exhaust side of the diffusion pump. The cooling system (water or air) for the outer body is turned on and the oil can now be heated by the heater for, for example, fifteen to twenty minutes, when it begins to boil. Hot vapour rises up the chimney and forms (aided by the taper) a relatively high oil pressure at the top of the chimney. The vapour is then urged through the passageway between the chimney and the top cap, the jet stage, to an area of much lower pressure and creates an annular vapour jet. This jet is designed to move at a velocity which is supersonic and which impinges on the inside surface of the cooled outer body where the vapour condenses and condensed oil flows down the inside wall of the outer body and returns to the oil reservoir at the base of the body.

With the diffusion pump turned on, gas molecules being pumped in to the inlet of the diffusion pump are likely to collide with the much heavier oil vapour molecules and be provided with a velocity component which will direct the gas molecules towards the outlet of the diffusion pump where they will be subsequently removed from the diffusion pump via the backing pump. A pressure difference is thereby established across the continuously flowing vapour jet.

Frequently, in the context of scientific instrument applications, for example, mass spectrometry applications, there is a requirement for differentially pumped chambers. That is to say a chamber to be evacuated may be divided into discreet compartments by partitions and each compartment may need to be pumped down to a vacuum pressure different from the remaining compartments. Currently this need is met by the use of two or more diffusion pumps each associated with a specific chamber/compartment. Clearly, this is a costly solution and sometimes space limitations make this solution difficult to apply.

SUMMARY OF THE INVENTION

It is an aim of the present invention to provide a diffusion pump having at least two inlets, each of which can be utilised to expose a chamber or compartment within a chamber, with a preselected vacuum pressure and pumping speed.

According to the present invention, a diffusion pump comprises a hollow outer body including an outlet for connection to a backing pump and a base for containing a working fluid, a vapour chimney extending from the base within the hollow outer body and including at least two spaced apart jet stages, means for heating the working fluid when present in said base, wherein at least two inlets are formed in the hollow outer body for communicating with chamber (s) to be evacuated.

In a preferred embodiment, two jet stages and two inlets are provided, each inlet being positioned proximal to an associated jet stage.

BRIEF DESCRIPTION OF THE DRAWINGS

An embodiment of the invention will now be described, by way of example, reference being made to the FIGURE of the accompanying diagrammatic drawing which is a cross-section through a diffusion pump.

DETAILED DESCRIPTION

As shown, a diffusion pump 1 comprises a hollow outer body 2 of circular cross-section, a major portion of which is provided with cooling coils 4. The body 2 includes a base 6 and a vapour chimney 8 is positioned within the outer body 2 such that its base portion 10 fits accurately within the base 6 creating an annular gap connecting to the lower portion of the base. A working fluid (not shown) is located in the base portion 10 of the chimney 8 as is a heater 18.

As shown, the chimney 8 is formed with first and second jet stages 12, 14.

The diffusion pump 1 also includes an outlet 16 for connection to a backing pump and a first inlet 20 to which (by means not shown) a first chamber/compartment to be evacuated is attached. The first inlet 20 as shown is located adjacent the first stage 12.

In accordance with the present invention, the diffusion pump 1 is provided with a second inlet 22 to which (by means not shown) a different chamber/compartment to be evacuated is attached. As shown the inlet 22 is positioned adjacent the second jet stage 14.

In use, when the respective inlets 20, 22 are attached to their respective chambers/compartments, the backing pump is turned on to reduce the pressure within the diffusion pump 1 and if necessary a coolant is passed through the coils 4.

Heating of the working fluid by means of the heater 18 causes boiled vapour to rise up the chimney 8 in the general manner described earlier and to emerge through the jet stages 14, 12 and thereafter to fall downwardly in the general direction of the base along the inner surface of the body 2.

In the above described embodiment, the chamber connected to the inlet 20 will be exposed to a lower pressure and a higher pumping speed relative to the chamber connected to the inlet 22. The diffusion pump 1 of the present invention which can offer this additional inlet 22 accommodated adjacent the second jet stage 14, provides an additional lower pumping speed and higher pressure when compared with the first inlet 20. This flexibility has great utility when differential pumping is required.

In a modification, it is contemplated that the chimney 8 above the second jet stage 14 could be bifurcated and each bifurcation provided with its own jet stage. In this arrangement again two inlets may be provided one adjacent each of the two jet stages as well as a further inlet arranged adjacent the second jet stage. In other words one can provide a diffusion pump having two or more jet stages each with its associated inlet but with only a single base and associated heater.

I claim:

1. A diffusion pump for evacuating at least two chambers comprising:

a hollow body including an outlet for connection to a backing pump and a base for containing a working fluid;

a vapour chimney extending from the base within the hollow body and including at least two spaced apart jet stages;

means for heating the working fluid when present in said base; and at least two inlets formed in the hollow body for communicating with said at least two chambers to be evacuated;

each of the at least two inlets positioned proximal to an associated jet stage.

* * * * *